US005574420A

United States Patent [19]

Roy et al.

[11] Patent Number: 5,574,420

[45] Date of Patent: Nov. 12, 1996

[54] LOW PROFILE SURFACE MOUNTED MAGNETIC DEVICES AND COMPONENTS THEREFOR

[75] Inventors: Apurba Roy, Rockwall; Steven A. Shewmake, Mesquite; James C. Wadlington, Dallas, all of Tex.

[73] Assignee: Lucent Technologies Inc., Murray Hill, N.J.

[21] Appl. No.: 250,075

[22] Filed: May 27, 1994

[51] Int. Cl.[6] ..... H01F 27/24; H01F 27/30

[52] U.S. Cl. ..... 336/200; 336/212; 336/223; 336/233

[58] Field of Search ..... 336/200, 232, 336/65, 178, 212, 233, 223, 180

[56] References Cited

U.S. PATENT DOCUMENTS

| | | | |
|---|---|---|---|
| 3,614,554 | 10/1971 | Richardson et al. | 336/200 |
| 3,731,005 | 5/1973 | Shearman | 336/200 |
| 4,455,545 | 6/1984 | Shelly | 336/200 |
| 4,547,961 | 10/1985 | Bokil et al. | 29/602 |
| 4,975,671 | 12/1990 | Dirks | 336/200 |

FOREIGN PATENT DOCUMENTS

| | | | |
|---|---|---|---|
| 1952160 | 5/1970 | Germany | H01F 17/00 |
| 1055813 | 2/1989 | Japan | H01F 27/28 |
| 1-265505 | 10/1989 | Japan | 336/200 |
| 2-10705 | 1/1990 | Japan | 336/200 |
| 3-263805 | 11/1991 | Japan | 336/200 |
| 5-82352 | 4/1993 | Japan | 336/200 |

OTHER PUBLICATIONS

D. Bokil et al. "Thick–film transformer advances hybrid isolation amplifier" *Electronics*, pp. 113–117 (1981).

P. M. Gradzki et al. "Design Of High–Frequency Hybrid Power Transformer" IEEE pp. 319–326 (1988).

*Primary Examiner*—Thomas J. Kozma
*Attorney, Agent, or Firm*—Glen E. Books; Robert E. Rudnick

[57] ABSTRACT

In accordance with the invention, a variety of magnetic devices can be made up of two or more low-profile surface components on a printed circuit board. For example, low profile devices comparable to gapped U-core pair and gapped E-core pair inductors or transformers can be formed of two and three components, respectively, and four components can be assembled into a gapped toroidal transformer or inductor. The components can be made in form for both linear and non-linear inductors.

21 Claims, 4 Drawing Sheets

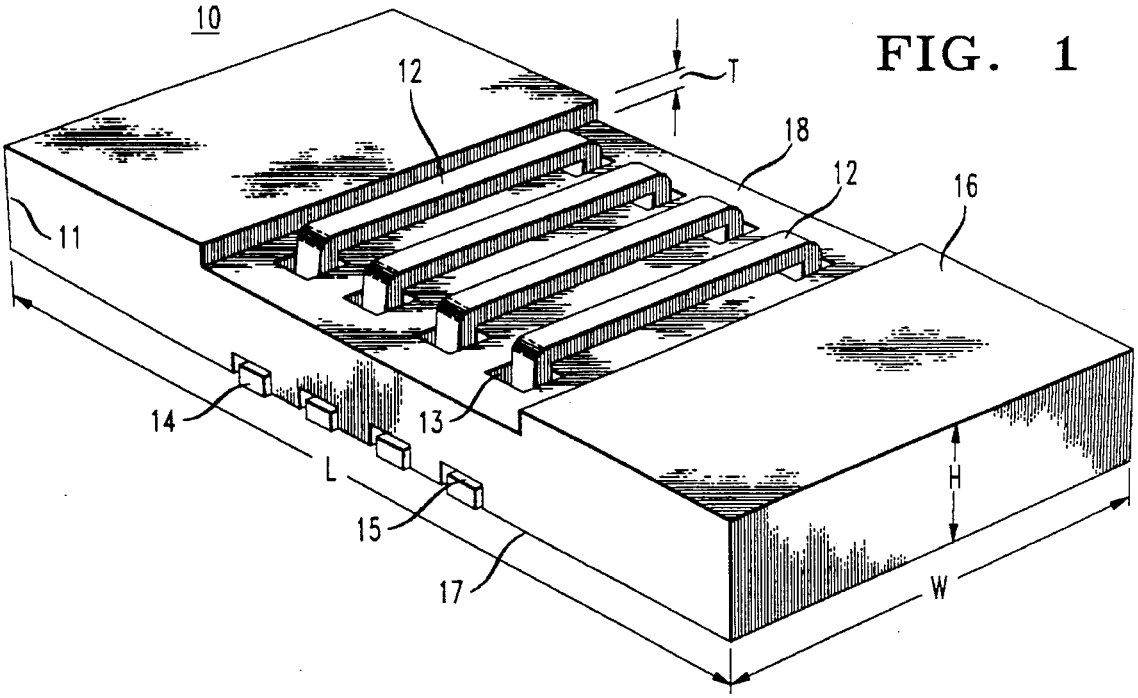
FIG. 1
FIG. 2
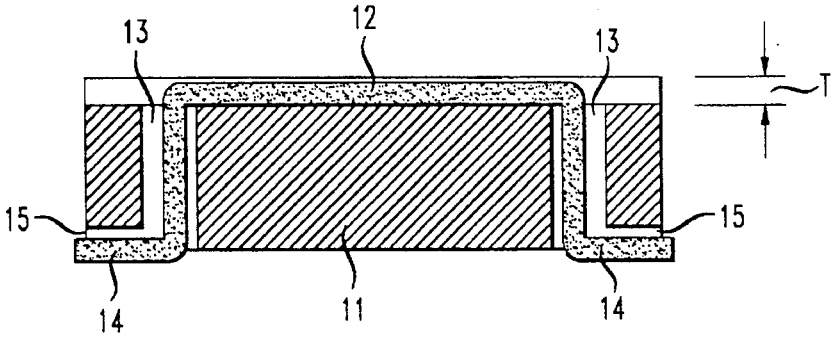
FIG. 3
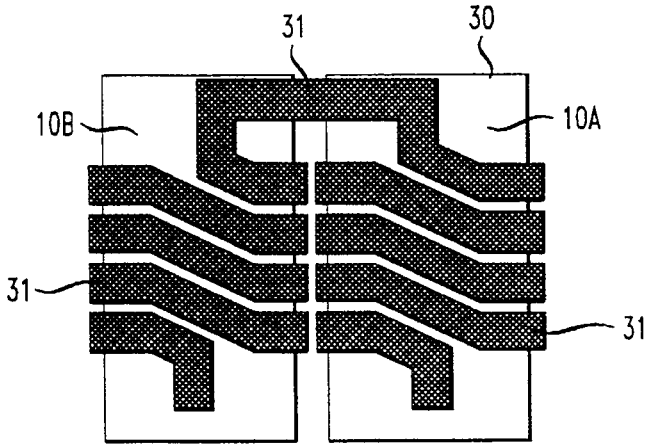

LOW PROFILE SURFACE MOUNTED MAGNETIC DEVICES AND COMPONENTS THEREFOR

TECHNICAL FIELD

This invention relates to magnetic devices such as inductors and transformers and, in particular, to magnetic devices which can be assembled as low profile surface mounted devices on a printed circuit board or a metallized substrate.

BACKGROUND OF THE INVENTION

Magnetic devices, such as inductors and transformers, serve a wide variety of essential functions in many electronic devices. In power supplies, for example, inductors are used as choke coils for energy storage and to minimize noise and AC ripple, and transformers are used to change voltage level and to provide isolation. Such devices are often made of a magnetic core, such as iron or ferrite, wound with conductive coils. Consequently, they are sometimes referred to as wire-wound core devices.

One major difficulty with wire-wound core devices is that they have been difficult to miniaturize. While components such as resistors, diodes, capacitors and transistors have been shrunk to the microscopic level, wire-wound core devices remain bulky and typically must be assembled as complete units before being applied in hybrid circuits.

SUMMARY OF THE INVENTION

In accordance with the invention, a variety of magnetic devices can be made up of two or more low-profile surface mounted components on a printed circuit board. For example, low profile devices comparable to gapped U-core pair and gapped E-core pair inductors or transformers can be formed of two and three components, respectively, and four components can be assembled into a gapped toroidal transformer or inductor. The components can be made in form for both linear and non-linear inductors.

BRIEF DESCRIPTION OF THE DRAWINGS

The advantages, nature and various additional features of the invention will appear more fully upon consideration of the illustrative embodiments now to be described in detail in connection with the accompanying drawings. In the drawings:

FIGS. 1 and 2 are perspective and cross sectional views of a first embodiment of a component suitable for forming inductors and transformers on a printed circuit board;

FIG. 3 shows a printed circuit board patterned for interconnecting two FIG. 1 components in a gapped U-core pair configuration;

Figure 4:
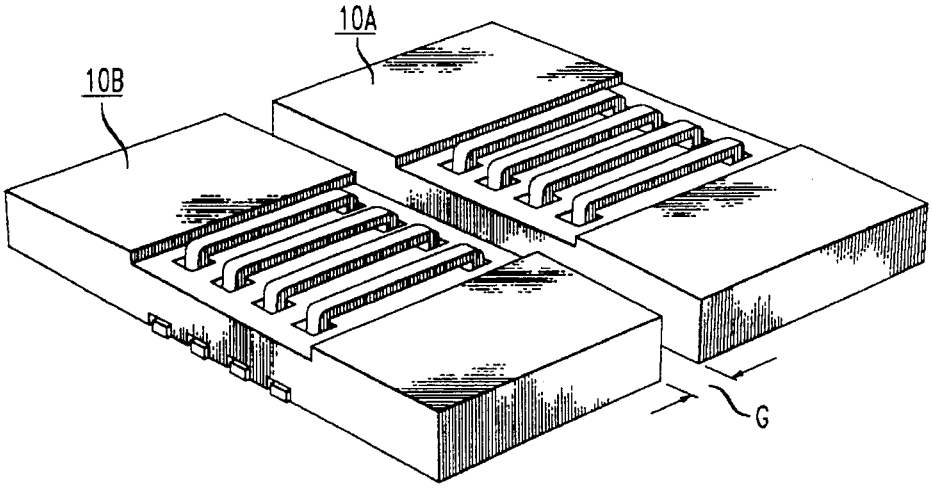
FIG. 4 shows an assembly of two FIG. 1 components into a configuration comparable to a partially gapped U-core pair inductor.

It is to be understood that these drawings are for purposes of illustrating the concepts of the invention and, except for graphical illustrations, are not to scale.

DETAILED DESCRIPTION

Referring to the drawings, FIG. 1 is a perspective view of a first embodiment of a low profile, surface mountable magnetic component 10 comprising body 11 of magnetic material containing a plurality of conductive elements 12 distributed along the major dimension of the body. Each element 12 partially surrounds a portion of the body, and each has a pair of contact surfaces 14 aligned on a common plane. For the preferred low-profile embodiment, the body 11 comprises a pair of parallel major surfaces 16 and 17 spaced apart by a distance H less than 0.10 in. Advantageously, major surface 16 has one or more regions 18 recessed by an amount T approximately equal to the thickness of a conductive element 12 so that the elements do not project above the top of the body. As better shown in the cross section of FIG. 2, openings 13 are provided so that the conductive elements 12 can extend through the body 11. Advantageously, each conductive element is a rigid U-shaped element provided with bent ends extending toward the body edge to act as contact surfaces 14. Recesses 15 are advantageously provided in surface 17 so that contact portions 14 project only minimally below the bottom surface of body 11. As can be seen in FIG. 2 each conductive element partially surrounds only a portion of the body cross section in the plane of the conductive element.

In a preferred embodiment body 11 is a ferrite material such as manganese-zinc ferrite ($Mn_{1-x}Zn_xFeO_4$) or nickel-zinc ferrite ($Ni_{1-x}Zn_xFeO_4$) where $0 \leqq x \leqq 1$. The conductive elements 12 are preferably copper staples plated with nickel, tin and solder. The body with holes 13 is formed by dry pressing powder and sintering. Preferably the body is a rectangular parallelepiped having a length L greater than width W and the conductive elements 12 are distributed along the length, each parallel to the width dimension. The staples are inserted into the holes and their ends are bent to the side. Advantageously, Kapton labels (not shown) are placed on the top major surface of the body so that the finished component can be picked up with a vacuum head in assembling magnetic devices on a circuit board. Exemplary dimensions for the body are: height 0.075 in, length 0.375 in, and width 0.220 in. The upper recess T (and also staple thickness) can be 0.012 in and the lower recess 0.007 in. As will be appreciated from these dimensions, the component has a low profile and is highly compact.

A magnetic device is made by mounting a plurality of the components (shown in FIGS. 1 and 2) onto the surface of an insulating substrate having a plurality of conducting elements for interconnecting appropriate contact surfaces of the elements 12. Specifically, it is contemplated that the component will be mounted on a printed circuit board having a pattern of conductors for interconnecting a contact surface of a first conductive element 12 with a contact surface of a second conductive element 12 in such fashion that the interconnected conducting elements form a winding around a portion of the magnetic body. Moreover, the conductive elements on the circuit board are arranged for coupling the magnetic components in a magnetic circuit.

Figure 5:
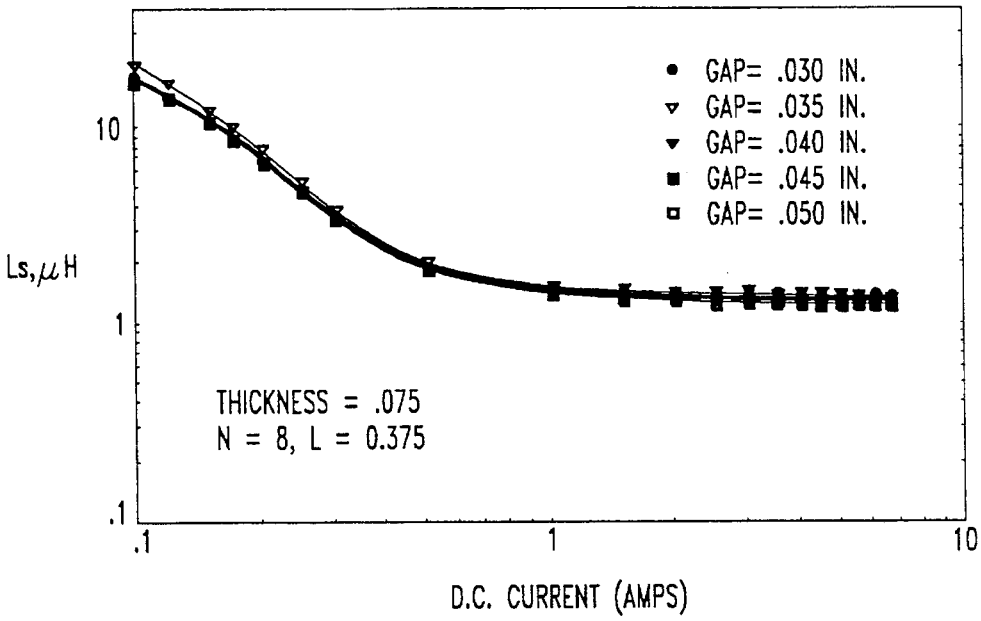
FIG. 5 is a graphical plot of the current-inductance characteristic for the device of FIG. 4 for different gap spacings.

Using the component of FIGS. 1 and 2 and printed circuit boards, one can assemble a variety of magnetic devices. FIG. 3, for example, shows a pattern of printed conductive ribbons 31 for interconnecting two components 10A and 10B in series, mounted side-by-side in a magnetic circuit producing a low profile gapped U-core pair inductor. FIG. 4 shows the two components 10A and 10B mounted side-by-side with a uniform gap G between them. The inductance-dc current characteristic of this device shown in FIG. 5.

Figure 7:
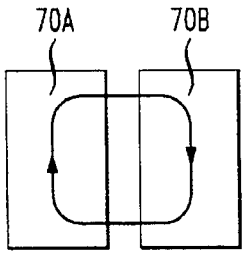
FIG. 7 shows an assembly of FIG. 6 components into a two component inductor or transformer.
Figure 6:
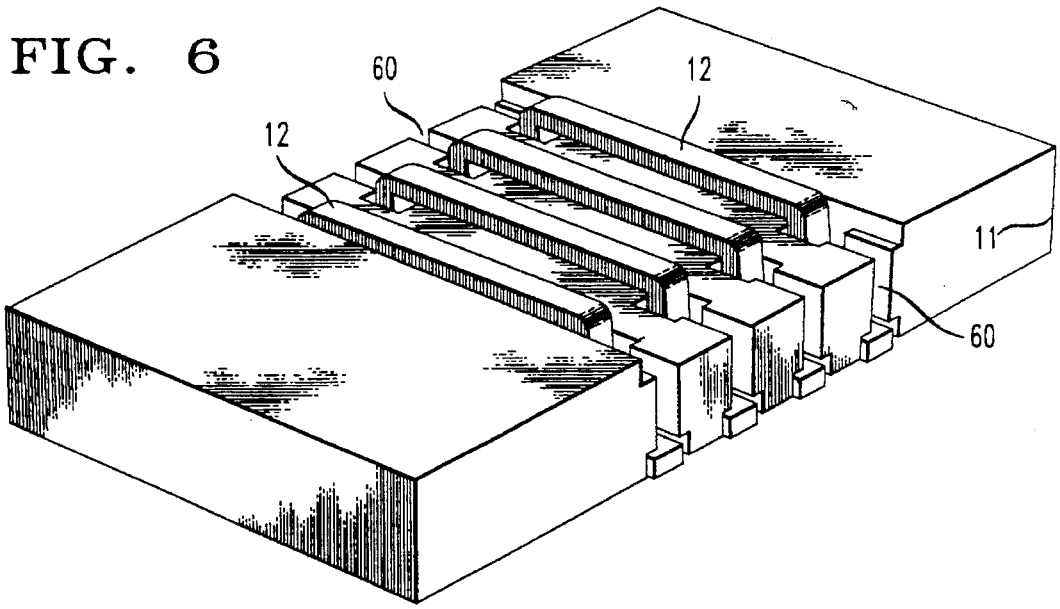
FIG. 6 is a perspective view of a second embodiment of a component similar to that of FIG. 1 but adapted for forming linear inductors.
Figure 8:
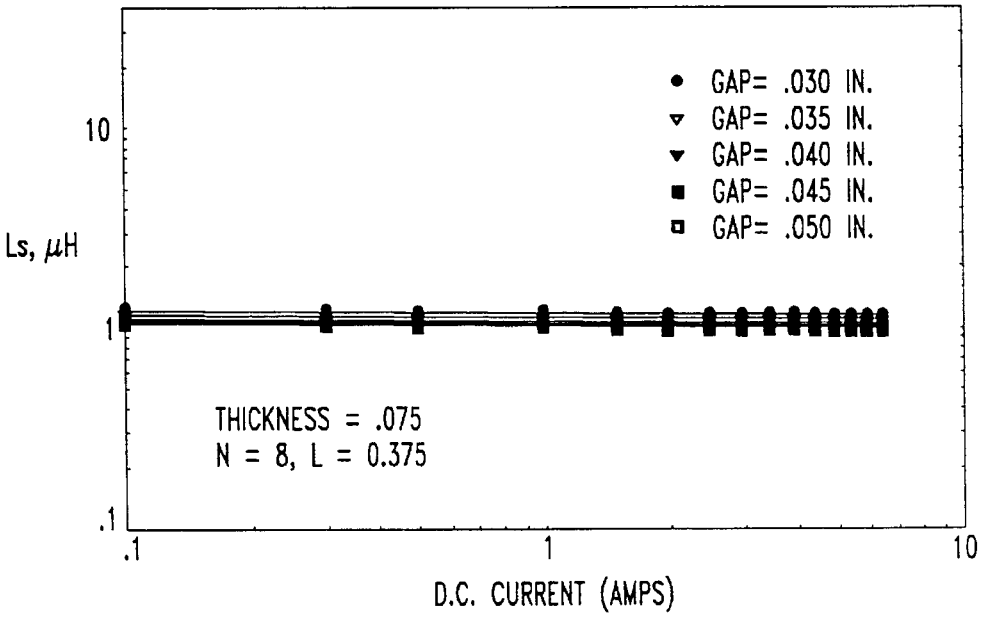
FIG. 8 is a graphical plot of the current-inductance characteristic for the gapped U-core pair inductor of FIG. 7.

FIG. 6 is a perspective view of a second embodiment of a magnetic component adapted for forming linear inductors. Specifically, the component of FIG. 6 is similar to that of FIG. 1 except that gaps 60 are provided in the regions between the respective conductive elements 12 and the body edge. These gaps minimize the magnetic fields between the staples and the body edge, producing an inductance which is constant with increasing DC current. For example, if two FIG. 6 components 70A and 70B are placed side-by-side and connected in series to form a gapped U-core pair inductor the magnetic flux path is as shown in FIG. 7, and the inductance-dc current characteristic is linear as shown in FIG. 8. In the FIG. 6 embodiment, each conductive element partially surrounds the entirety of the body cross section in the plane of the conductive element.

Figure 9:
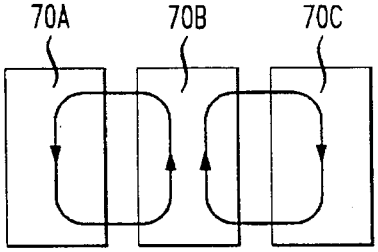
FIGS. 9 and 10 show assemblies of FIG. 6 components into 3 and 4 component inductors or transformers, respectively.
Figure 10:
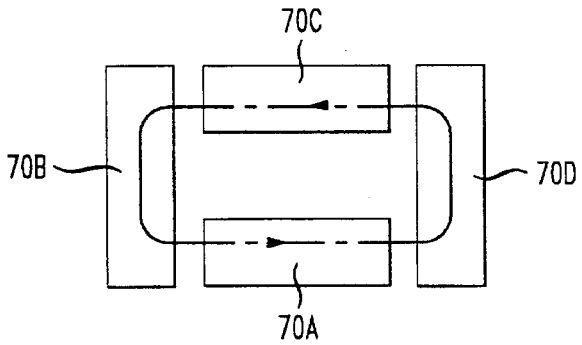

FIG. 9 shows three components 70A, 70B, 70C surface mounted side by side in a magnetic circuit to form a low profile E-core inductor or transformer, and FIG. 10 shows four components 70A–70D mounted in a rectangular magnetic circuit equivalent to a gapped toroid.

Magnetic coupling of plural components permits the fabrication of advantageous magnetic devices. In addition to confining the magnetic flux within component bodies, magnetically coupled components can provide higher levels of inductance than a corresponding number of uncoupled components. (Magnetic coupling, for purposes of this invention refers to components 1, 2 having a coupling coefficient, $K \geqq 0.5$ where K is equal to the mutual inductance $M_{12}$ divided by the square root of the product of the respective inductances L1 and L2.)

Figure 11:
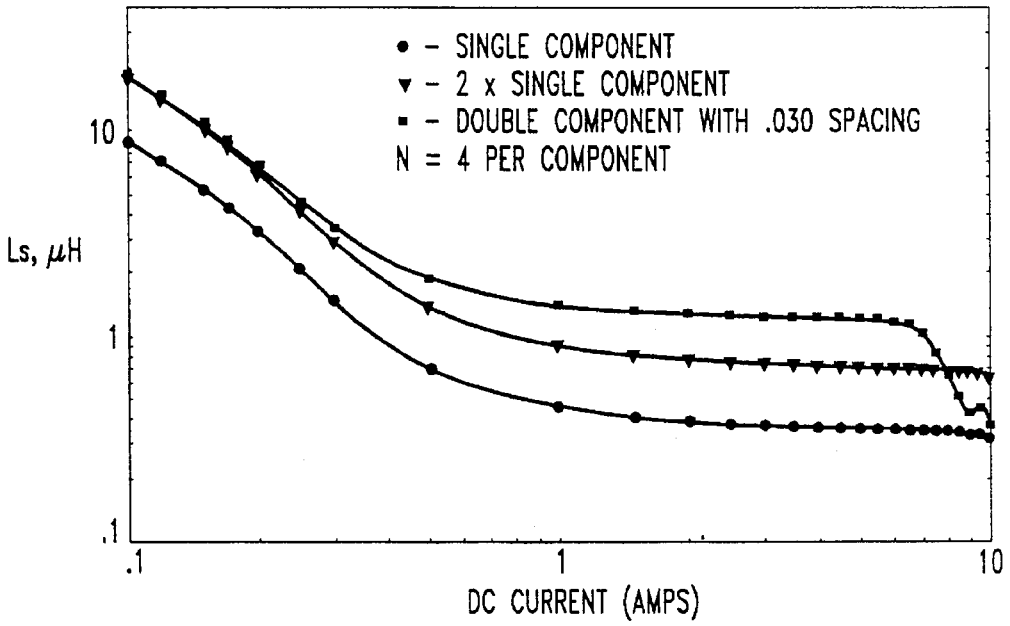
FIG. 11 is a graphical plot useful for explaining the effect of magnetically coupling components of the type shown in FIG. 1.

FIG. 11 illustrates the advantage of magnetically coupling components of the type shown in FIG. 1. The line of circles shows inductance as a plot of DC current for a single component. The line of triangles plots twice the inductance for a single component, and the line of squares shows the inductance plot for a magnetically coupled two-component device as illustrated in FIG. 4 with a spacing G=0.030 in. At large currents, the coupled device has an inductance larger than two uncoupled components and approximately 3.8 times that of a single component. The coupled components retain the characteristic non-linear profile of the FIG. 1 device.

Figure 12:
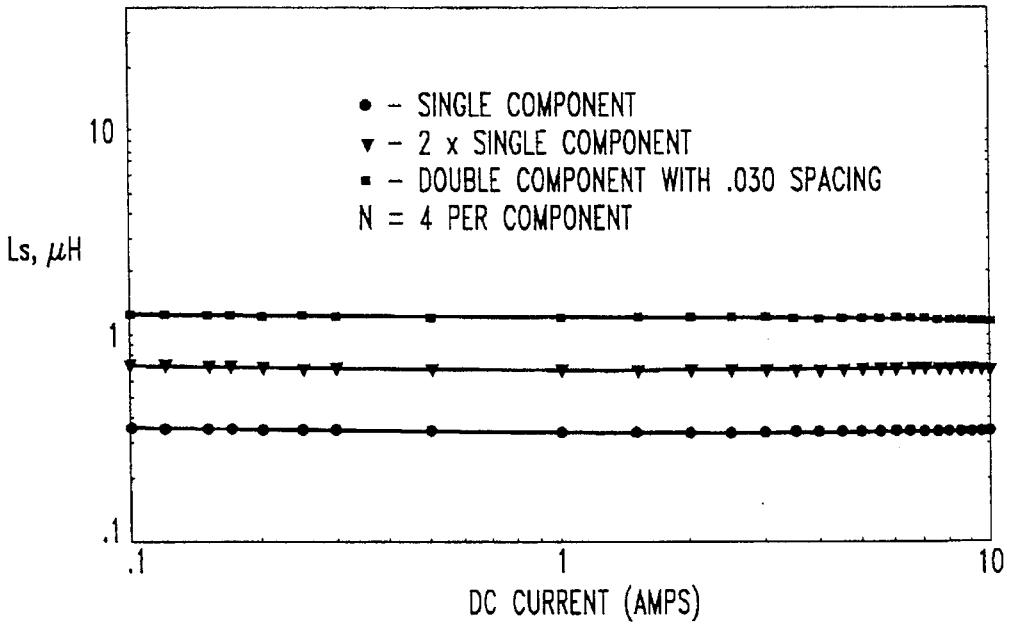
FIG. 12 is a graphical plot for explaining the effect of magnetically coupling components of the type shown in FIG. 6.

FIG. 12 similarly illustrates the advantage of magnetically coupling components of the type shown in FIG. 6. Again two coupled components have an inductance which is more than twice a single component but retain the linear profile of the FIG. 6 device.

It is to be understood that the above-described embodiments are illustrative of only a few of the many possible specific embodiments which can represent applications of the principles of the invention. Numerous and varied other arrangements can be made by those skilled in the art without departing from the spirit and scope of the invention.

We claim:

1. A magnetic device comprising:

a plurality of components, each component comprising a separate magnetic ferrite body and a plurality of conductive elements, each conductive element partially surrounding a portion of said body and having a pair of contact surfaces aligned along a common plane, wherein at least a portion of each conductive element extends through a respective aperture in said body to maintain a position of said conductive element relative to said body;

an insulating substrate including a second plurality of conductive elements adhered to a surface of said substrate for interconnecting said contact surfaces of the conductive elements of respective components to form conductive windings around portions of said body of said respective components; and said conductive elements on said insulating substrate arranged for magnetically coupling said plurality of said components in a magnetic circuit.

2. A magnetic device according to claim 1 wherein each conductive element of at least one said component comprises a U-shaped conductive element.

3. A magnetic device according to claim 1 wherein said insulating substrate comprises a printed circuit board and each conductive element of said second plurality comprises a conductive strip printed on said board.

4. A magnetic device according to claim 1 wherein said magnetic circuit comprises a pair of said components mounted on said substrate.

5. A magnetic device according to claim 1 wherein said magnetic circuit comprises three said components mounted side-by-side on said substrate.

6. An magnetic device according to claim 1 wherein said magnetic circuit comprises four said components mounted on said substrate.

7. A magnetic device according to claim 1 wherein said body of at least one said component comprises a pair of major surfaces spaced apart by a distance of less than 0.1 inch.

8. A magnetic device according to claim 1 wherein said body of at least one said component is a rectangular parallelepiped having a length greater than width and said conductive elements of said component are distributed along the length of said body and are each parallel to the width dimension.

9. A magnetic device according to claim 1 wherein each said conductive element of at least one said component partially surrounds a portion of said body.

10. A magnetic device according to claim 1 wherein each said conductive element of at least one said component partially surrounds said body.

11. A magnetic device comprising:

a plurality of components, each component comprising a magnetic ferrite body and a plurality of conductive elements, each conductive element partially surrounding a portion of said body and having a pair of contact surfaces aligned along a common plane, wherein at least a portion of each conductive element extends through a respective gap in at least one edge region of said body to maintain a position of said conductive element relative to said body;

an insulating substrate including a second plurality of conductive elements adhered to a surface of said substrate for interconnecting said contact surfaces of the conductive elements of respective components to form conductive windings around portions of said body of said respective components; and said conductive elements on said insulating substrate arranged for magnetically coupling said plurality of said components in a magnetic circuit.

12. A magnetic device according to claim 11 wherein each conductive element of at least one said component comprises a U-shaped conductive element.

13. A magnetic device according to claim 11 wherein said insulating substrate comprises a printed circuit board and each conductive element of said second plurality comprises a conductive strip printed on said board.

14. A magnetic device according to claim 11 wherein said magnetic circuit comprises a pair of said components mounted on said substrate.

15. A magnetic device according to claim 11 wherein said magnetic circuit comprises three said components mounted side-by-side on said substrate.

16. A magnetic device according to claim 11 wherein said magnetic circuit comprises four said components mounted on said substrate.

17. A magnetic device according to claim 11 wherein said body of at least one said component comprises a pair of major surfaces spaced apart by a distance of less than 0.1 inch.

18. A magnetic device according to claim 11 wherein said body of at least one said component is a rectangular parallelepiped having a length greater than width and said conductive elements of said component are distributed along the length of said body and are each parallel to the width dimension.

19. A magnetic device according to claim 11 wherein each said conductive element of at least one said component partially surrounds a portion of said body.

20. A magnetic device according to claim 11 wherein each said conductive element of at least one said component partially surrounds said body.

21. The magnetic device of claim 11 wherein said gaps have a shape that provides at least partial securing of said conductive elements to the body.

* * * * *